US009371995B2

(12) United States Patent
Bagwell et al.

(10) Patent No.: US 9,371,995 B2
(45) Date of Patent: Jun. 21, 2016

(54) PULSED WATER FLUSH OF LIQUID FUEL VALVES AND COMBUSTION NOZZLES

(71) Applicant: General Electric Company, Schenectady, NY (US)

(72) Inventors: Joshua Adam Bagwell, Greer, SC (US); Mark Jason Fisher, Simpsonville, SC (US); Kenneth Eugene Selfridge, Piedmont, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 651 days.

(21) Appl. No.: 13/829,271

(22) Filed: Apr. 11, 2013

(65) Prior Publication Data

US 2014/0305512 A1 Oct. 16, 2014

(51) Int. Cl.

| | |
|---|---|
| ***F02G 3/00*** | (2006.01) |
| ***F23K 5/18*** | (2006.01) |
| ***F23R 3/28*** | (2006.01) |

(52) U.S. Cl.

CPC ... *F23K 5/18* (2013.01); *F23R 3/28* (2013.01); *F23D 2209/30* (2013.01); *F23N 2027/06* (2013.01); *Y10T 137/043* (2015.04)

(58) Field of Classification Search

CPC ..... F02C 7/232; F02C 7/22; F02C 7/222; F23K 5/18; F23D 2209/30; F05B 2260/602

See application file for complete search history.

(56) References Cited

U.S. PATENT DOCUMENTS

| | | | | |
|---|---|---|---|---|
| 3,128,779 | A * | 4/1964 | Morris | 134/107 |
| 4,214,435 | A * | 7/1980 | Campbell | 60/775 |
| 6,216,439 | B1 * | 4/2001 | Nakamoto | 60/39.094 |
| 6,250,065 | B1 * | 6/2001 | Mandai et al. | 60/776 |
| 6,256,975 | B1 | 7/2001 | Dobbeling et al. | |
| 8,104,258 | B1 * | 1/2012 | Jansen et al. | 60/39.281 |
| 8,573,245 | B1 * | 11/2013 | Jansen | 137/240 |
| 2011/0146807 | A1 * | 6/2011 | Bassmann et al. | 137/15.05 |
| 2011/0289927 | A1 * | 12/2011 | Wagner | 60/734 |
| 2013/0097991 | A1 * | 4/2013 | Zhang et al. | 60/39.59 |

FOREIGN PATENT DOCUMENTS

| | | | | |
|---|---|---|---|---|
| EP | 0 939 220 | | 9/1999 | |
| JP | 2001059427 | A * | 3/2001 | F02C 7/232 |

* cited by examiner

*Primary Examiner* — Gerald L Sung

(74) *Attorney, Agent, or Firm* — Nixon & Vanderhye P.C.

(57) ABSTRACT

A method of flushing liquid fuel from valves and nozzles in a gas turbine is conducted via a mixing valve including flow passages for fuel and water. In the method, water is flowed through the flow passages, and the flow is interrupted for a period of no flow. This flow profile is repeated such that the water flow is pulsed through the flow passages.

17 Claims, 6 Drawing Sheets

Pilot Forward Flush

Pilot Forward/Reverse Flush

PULSED WATER FLUSH OF LIQUID FUEL VALVES AND COMBUSTION NOZZLES

BACKGROUND OF THE INVENTION

The invention relates to gas turbines and, more particularly, to a method of effectively removing residual liquid fuel to reduce fuel coking.

When a gas turbine is shut down or transferred to gas-fuel operation after running on liquid fuel, a significant amount of liquid fuel may be left in or on the passages, crevices and walls of the liquid fuel system components, including the mixing valves and combustion nozzles. It is important for the residual liquid fuel to be sufficiently removed from inside the mixing valve assembly and combustion nozzles so that fuel coking and subsequent component malfunction does not occur. That is, when exposed to the high temperatures around the gas turbine, residual liquid fuel in those components tends to cook down into a thick sludge or varnish or "coke." That layer of coked fuel can inhibit valve operation and clog combustion passages, greatly reducing system reliability and operability.

It would be desirable to provide a methodology by which the liquid fuel is more completely removed from the valves and nozzles so that fuel no longer remains present in locations where it may be susceptible to coking. Prevention of coke formation is important to the reliability and operability of the liquid fuel system.

BRIEF DESCRIPTION OF THE INVENTION

In an exemplary embodiment, a mixing valve in a gas turbine includes a pilot fuel inlet, a water inlet, a main fuel inlet, a pilot discharge, and a main discharge. A method of flushing liquid fuel from valves and nozzles via the mixing valve includes the steps of (a) flowing water through at least one of (1) the water inlet to the pilot discharge, (2) the water inlet to the main discharge, (3) the water inlet to the pilot fuel inlet and the pilot discharge, and (4) the water inlet to the main fuel inlet and the main discharge; (b) interrupting step (a) for a period of no flow; and (c) repeating steps (a) and (b).

In another exemplary embodiment, the mixing valve has a plurality of flow valves cooperable with the flow passages including a first flow valve positioned between the pilot fuel inlet and the pilot discharge, a second flow valve positioned between the water inlet and the pilot discharge, a third flow valve positioned between the water inlet and the main discharge, and a fourth flow valve positioned between the main fuel inlet and the main discharge. The method includes the steps of (a) flowing water in a pilot forward flush mode by closing the first, third and fourth flow valves and opening the second flow valve such that the water flows through the water inlet to the pilot discharge; (b) flowing water in a pilot forward/reverse flush mode by closing the third and fourth flow valves and opening the first and second flow valves such that the water flows through the water inlet to the pilot fuel inlet and the pilot discharge; (c) flowing water in a main forward flush mode by closing the first, second and fourth flow valves and opening the third flow valve such that the water flows through the water inlet to the main discharge; (d) flowing water in a main forward/reverse flush mode by closing the first and second flow valves and opening the third and fourth flow valves such that the water flows through the water inlet to the main fuel inlet and the main discharge; (e) interrupting steps (a)-(d) for a period of no flow; and (f) repeating steps (a)-(e).

In yet another exemplary embodiment, a method of flushing liquid fuel from valves and nozzles in a gas turbine via a mixing valve includes the steps of (a) flowing water through flow passages of the mixing valve, (b) interrupting the flow for a period of no flow, and (c) repeating steps (a) and (b) such that the water flow is pulsed through the flow passages.

DETAILED DESCRIPTION OF THE INVENTION

Figure 1:
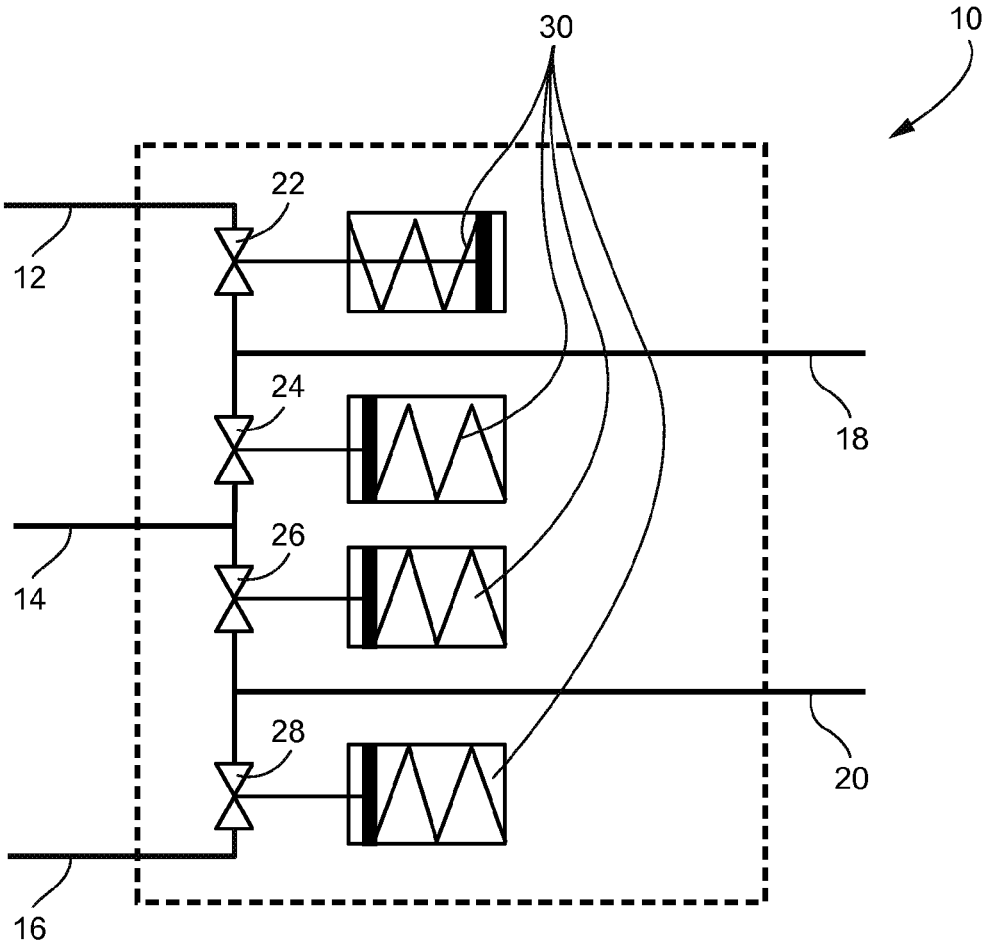
FIG. 1 is a schematic drawing of a mixing valve assembly.

FIG. 1 is a schematic illustration of a mixing valve assembly 10. The mixing valve assembly 10 is used for on/off control of liquid fuel, water, or fuel water mixture to the pilot and main circuits on a gas turbine combustor. The mixing valve includes a plurality of flow passages including a pilot fuel inlet 12, a water inlet 14, a main fuel inlet 16, a pilot discharge 18, and a main discharge 20. A plurality of flow valves are cooperable with the flow passages including a first flow valve 22 positioned between the pilot fuel inlet 12 and the pilot discharge 18, a second flow valve 24 positioned between the water inlet 14 and the pilot discharge 18, a third flow valve 26 positioned between the water inlet 14 and the main discharge 20, and a fourth flow valve 28 positioned between the main fuel inlet 16 and the main discharge 20. Pilot and main fuel manifolds supply the pilot fuel inlet 12 and main fuel inlet 16, respectively. A water manifold supplies the water inlet 14. The pilot discharge 18 and main discharge 20 connect to the pilot and main circuits on the gas turbine combustor and provide fuel, water, or a mixture of both. Four separate pneumatic actuators 30 for respective valves provide shut off to the various circuits.

Figure 2:
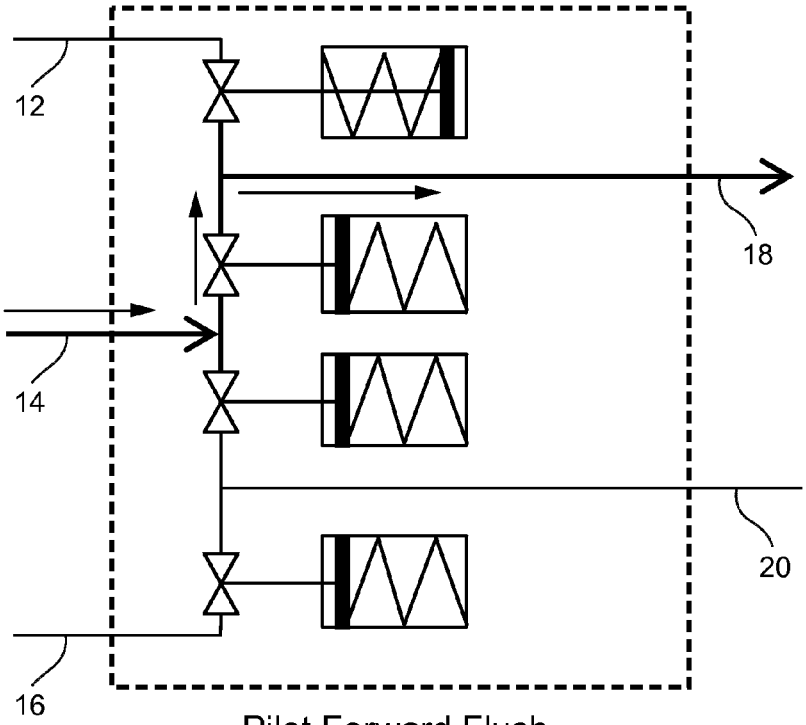
FIG. 2 shows the mixing valve assembly in a pilot forward flush mode.
Figure 3:
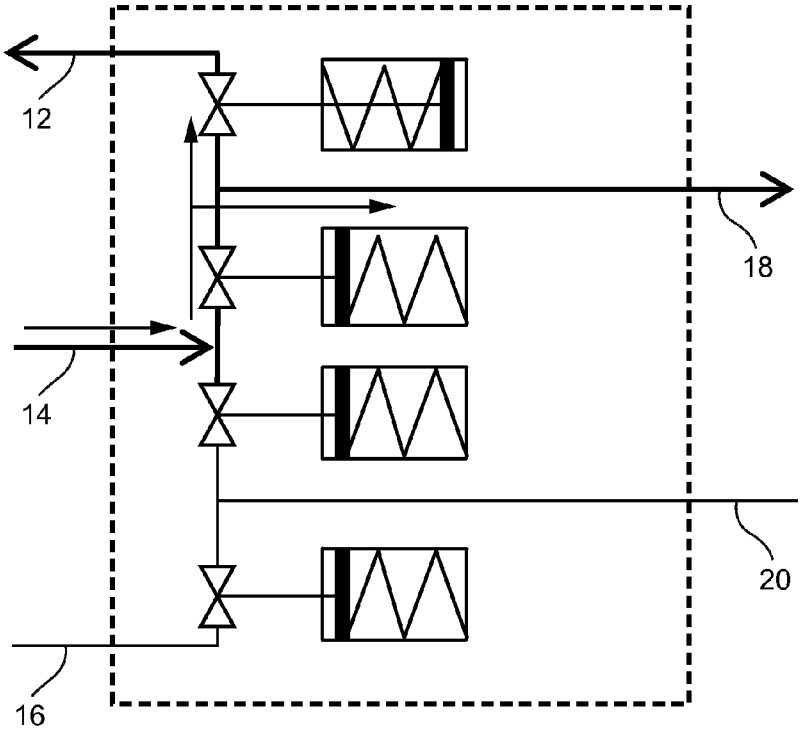
FIG. 3 shows the mixing valve assembly in a pilot forward/reverse flush mode.
Figure 4:
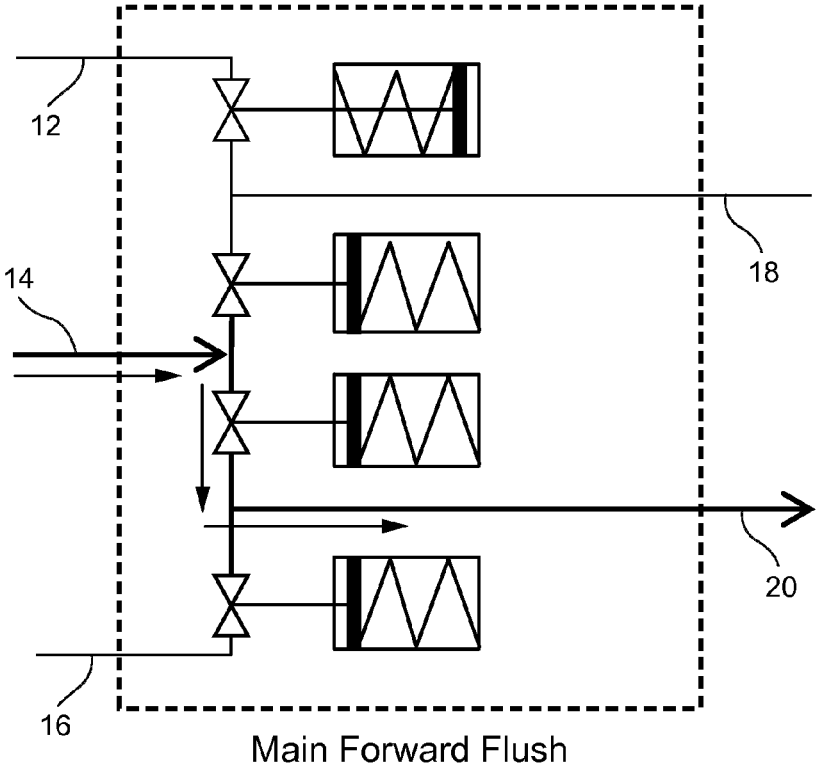
FIG. 4 shows the mixing valve assembly in a main forward flush mode.
Figure 5:
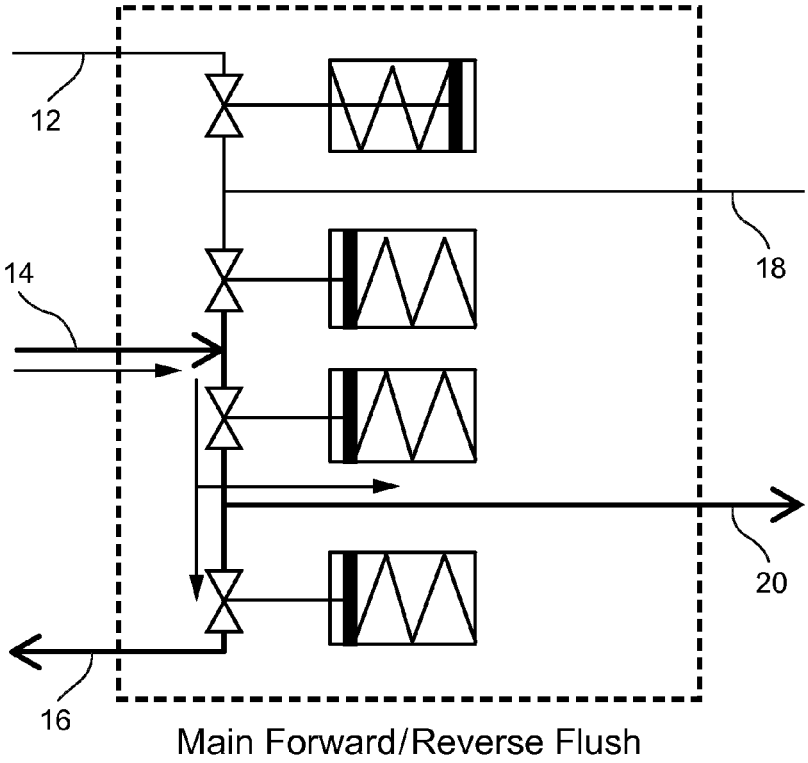
FIG. 5 shows the mixing valve assembly in a main forward/reverse flush mode.

The flushing method of the preferred embodiments uses water as the medium with which to flush any residual liquid fuel from the valve and nozzle passages, rather than using air or another gas or liquid. Water is flushed either forward or both forward and backward through the main or pilot mixing valve circuits as shown in FIGS. 2-5. In particular, FIG. 2 shows a pilot forward flush mode where the first flow valve 22, the third flow valve 26 and the fourth flow valve 28 are closed, and the second flow valve 24 is opened such that the water flows through the water inlet 14 to the pilot discharge 18 (see arrows in FIG. 2). FIG. 3 shows a pilot forward/reverse flush mode where the first 22 and second 24 flow valves are opened, and the third 26 and fourth 28 flow valves are closed such that the water flows through the water inlet 14 to the pilot fuel inlet 12 and the pilot discharge 18 (see arrows). FIG. 4 shows a main forward flush mode where the first flow valve 22, the second flow valve 24 and the fourth flow valve 28 are closed, and the third flow valve 24 is opened such that the water flows through the water inlet 14 to the main discharge 20 (see arrows). Finally, FIG. 5 shows a main forward/reverse flush mode where the first 22 and second 24 flow valves are closed, and the third 26 and fourth 28 flow valves are opened such that the water flows through the water inlet 14 to the main fuel inlet 16 and the main discharge 20 (see arrows). In addition to the modes shown in FIGS. 2-5, any of the pilot flushing modes can be performed simultaneously with any of the main flushing modes.

Testing has shown that steady flushing of the mixing valve assembly 10 may not sufficiently remove residual liquid fuel from the passageways, even with high flow rates. According to tests, flush effectiveness is greatly increased if the flushing is non-continuous; that is, if the flushing flow is interrupted by periods of no flow. These flow pulses are more effective for flushing the liquid fuel. In the method, combinations of the various flush modes are interrupted for a specified period of no flow, e.g., 10-30 seconds, and the flushing modes are subsequently repeated.

Figure 6:
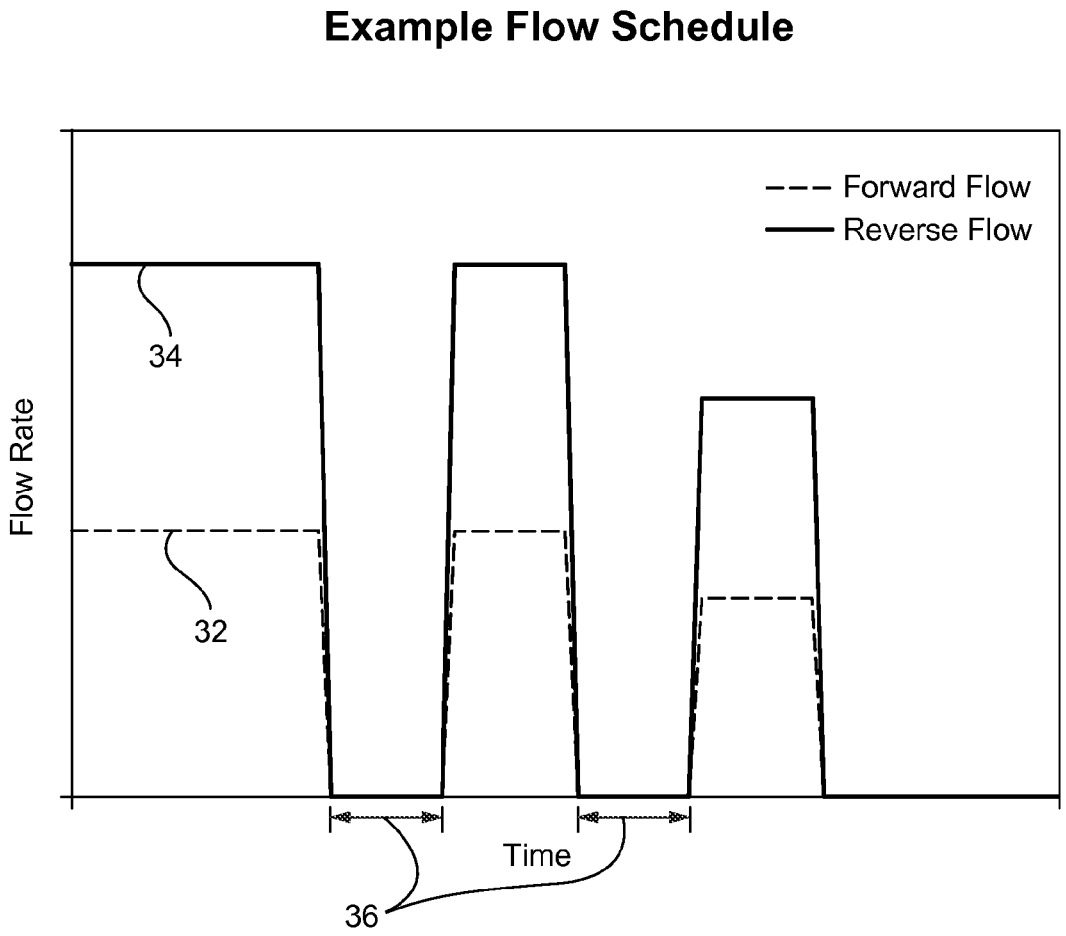
FIG. 6 shows an example flow schedule or flush strategy.

In the pulsed water flushing method, the flow rates, flow direction (forward or forward and backward), flow duration, pause duration and total number of pulses may all be varied to optimize the flush effectiveness for a particular system or hardware configuration. An exemplary flow schedule is shown in FIG. 6. The flow schedule shows a flow rate versus time. In an exemplary embodiment, a first amount of water or first flow rate flowable through the water inlet 14 to the pilot discharge 18 and through the water inlet 14 to the main discharge 20 is limited according to combustor hardware constraints. In FIG. 6, the first amount is represented by line 32. This flow represents the forward flow shown in FIGS. 2 and 4. A second amount of water or flow rate is flowable through the water inlet 14 to the pilot fuel inlet 12 and through the water inlet 14 through the main fuel inlet 16. This flow is represented by line 34 in FIG. 6 and represents reverse flow shown in FIGS. 3 and 5. Water flowing out the pilot fuel inlet 12 and the main fuel inlet 16 is not subject to combustor hardware constraints, and the second amount of water may be greater than the first amount. As seen in FIG. 6, it is typical to flow the water in the various flush modes with periods of no flow 36 to increase flush effectiveness via flow pulses.

Figure 7:
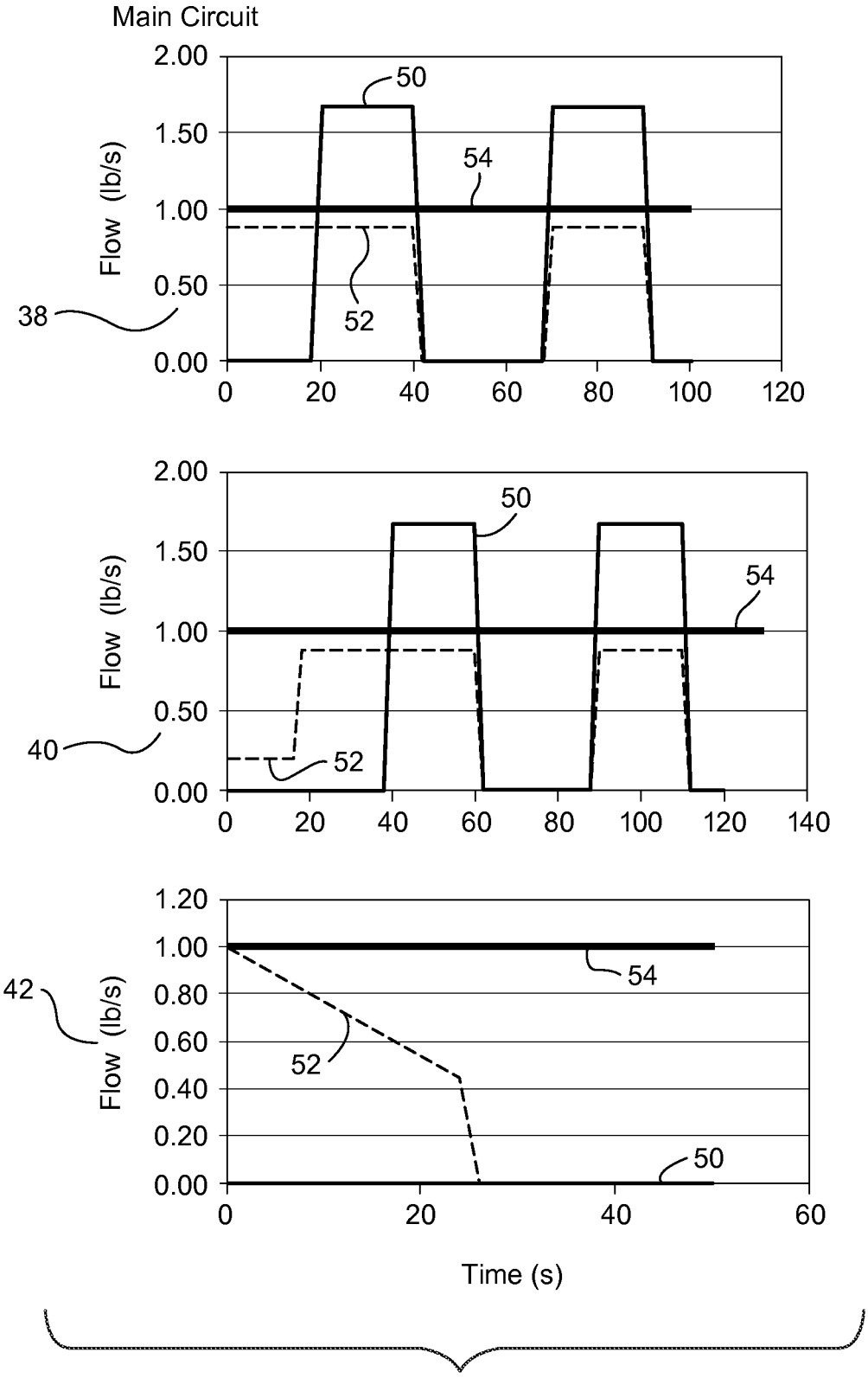
FIG. 7 shows mixing valve flush strategies for the main circuit.
Figure 8:
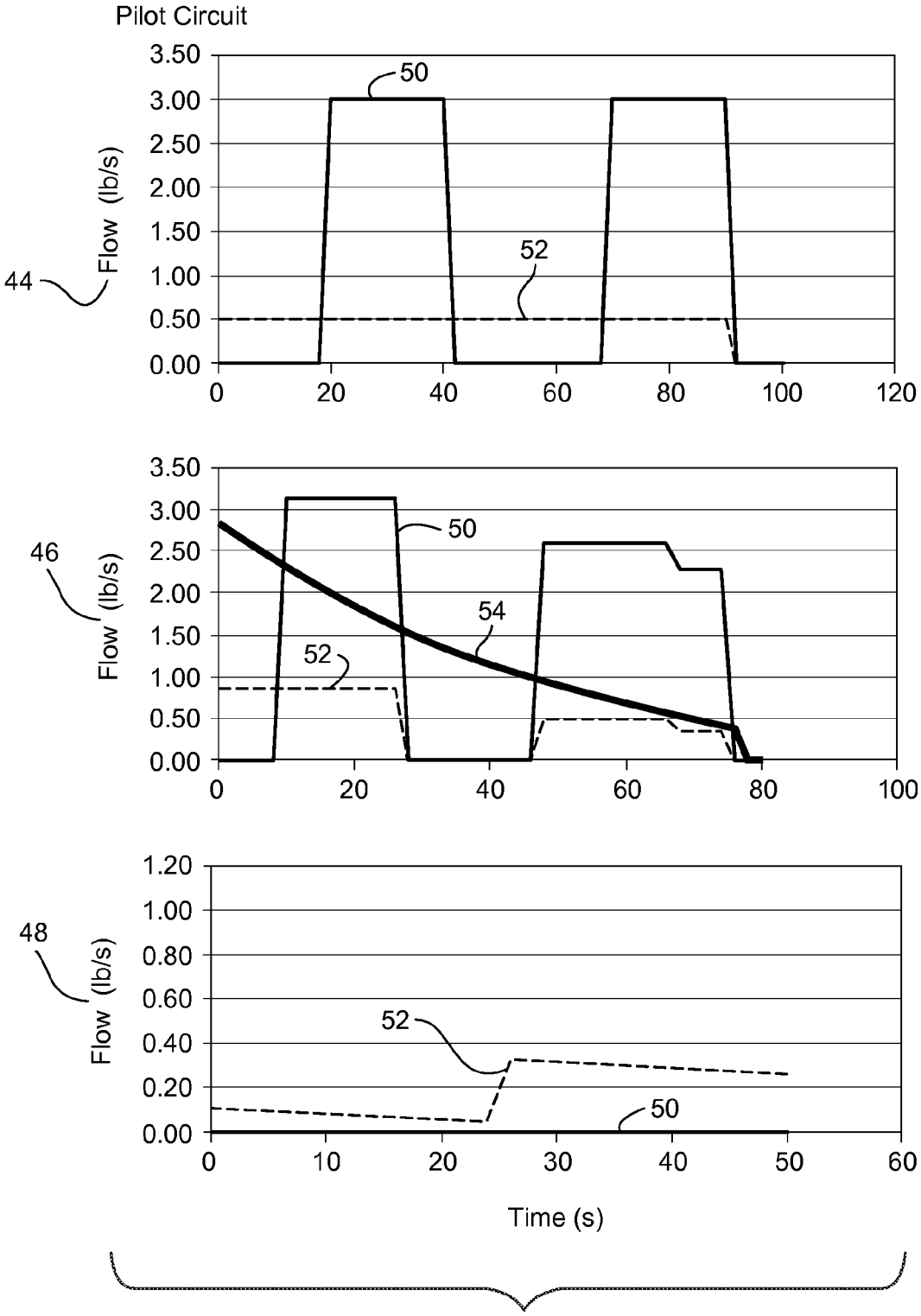
FIG. 8 shows mixing valve flush strategies for the pilot circuit.

With reference to FIGS. 7 and 8, the mixing valve flush strategies may vary based on an operating status of the gas turbine. Exemplary operating status may include start-up or shut down 38, load reject 40 or trip 42 in the main circuit. FIG. 8 shows flush strategies for the pilot circuit including start up 44, shut down 46 and trip 48. In each flush strategy shown, line 50 is representative of reverse flow, line 52 is representative of forward flow, and line 54 represents a flow limit for forward flow. As noted, the flush strategies are exemplary and would vary for a particular system or hardware configuration.

With the methodology of the preferred embodiments, liquid fuel removal is achieved by flushing the various mixing valve passages and nozzles with water in accordance with a prescribed pulsing schedule. Water is flushed through the mixing valve at the maximum flow rates allowed by the combustion system or water pump capability. Water flows forward through the mixing valve outlet circuits (and through the combustion nozzles) as well as backward through the mixing valve fuel inlets (and through the liquid fuel supply manifolds) at various stages of the flush sequence. At a given stage of the flush sequence, water may flow forward through the pilot circuit, main circuit, or both circuits; or forward and backward through either the pilot circuit, main circuit, or both circuits. The water flushing flow is interrupted by intervals of no flow, providing a pulsed flow effect that has been shown to greatly increase the amount of fuel successfully removed from the component passages as compared to a constant, uninterrupted flush.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A method of flushing liquid fuel from valves and nozzles in a gas turbine via a mixing valve assembly, the mixing valve assembly including a pilot fuel inlet, a water inlet, a main fuel inlet, a pilot discharge, and a main discharge, the method comprising:

(a) flowing water through at least one of (1) the water inlet to the pilot discharge, (2) the water inlet to the main discharge, (3) the water inlet to the pilot fuel inlet and the pilot discharge, and (4) the water inlet to the main fuel inlet and the main discharge;

(b) interrupting step (a) for a specified period of no flow; and (c) repeating steps (a) and (b) such that water flow is pulsed through the at least one of (1)-(4).

2. A method according to claim 1, wherein the mixing valve assembly comprises a first flow valve positioned between the pilot fuel inlet and the pilot discharge, a second flow valve positioned between the water inlet and the pilot discharge, a third flow valve positioned between the water inlet and the main discharge, and a fourth flow valve positioned between the main fuel inlet and the main discharge, and wherein step (a) is practiced in a pilot forward/reverse flush mode by closing the third and fourth flow valves and opening the first and second flow valves.

3. A method according to claim 1, wherein the mixing valve assembly comprises a first flow valve positioned between the pilot fuel inlet and the pilot discharge, a second flow valve positioned between the water inlet and the pilot discharge, a third flow valve positioned between the water inlet and the main discharge, and a fourth flow valve positioned between the main fuel inlet and the main discharge, and wherein step (a) is practiced in a main forward flush mode by closing the first, second and fourth flow valves and opening the third flow valve.

4. A method according to claim 1, wherein the mixing valve assembly comprises a first flow valve positioned between the pilot fuel inlet and the pilot discharge, a second flow valve positioned between the water inlet and the pilot discharge, a third flow valve positioned between the water inlet and the main discharge, and a fourth flow valve positioned between the main fuel inlet and the main discharge, and wherein step (a) is practiced in a main forward/reverse flush mode by closing the first and second flow valves and opening the third and fourth flow valves.

5. A method according to claim 1, wherein step (b) comprises interrupting step (a) for a period of no more than 10-30 seconds.

6. A method according to claim 1, wherein a first amount of water is flowable through the water inlet to the pilot discharge and through the water inlet to the main discharge, and wherein step (a) is practiced such that a second amount of water flowable through the water inlet to the pilot fuel inlet and through the water inlet to the main fuel inlet is greater than the first amount.

7. A method according to claim 1, wherein steps (a)-(c) are practiced according to a mixing valve flush strategy that varies according to whether a pilot circuit, including the pilot fuel inlet, the water inlet and the pilot discharge, or a main circuit, including the main fuel inlet, the water inlet and the main discharge, is being flushed, the mixing valve flush strategy including at least one of an amount of water flow and a duration of the water flow.

8. A method according to claim 7, wherein the mixing valve flush strategy further varies based on an operating status of the gas turbine.

9. A method according to claim 7, wherein step (a) is practiced by simultaneously flushing the pilot circuit and the main circuit.

10. A method of flushing liquid fuel from valves and nozzles in a gas turbine via a mixing valve assembly, the mixing valve assembly including a pilot fuel inlet, a water inlet, a main fuel inlet, a pilot discharge, and a main discharge, the method comprising:

(a) flowing water through at least one of (1) the water inlet to the pilot discharge, (2) the water inlet to the main discharge, (3) the water inlet to the pilot fuel inlet and the pilot discharge, and (4) the water inlet to the main fuel inlet and the main discharge;

(b) interrupting step (a) for a period of no flow; and (c) repeating steps (a) and (b), wherein the mixing valve assembly comprises a first flow valve positioned between the pilot fuel inlet and the pilot discharge, a second flow valve positioned between the water inlet and the pilot discharge, a third flow valve positioned between the water inlet and the main discharge, and a fourth flow valve positioned between the main fuel inlet and the main discharge, and wherein step (a) is practiced in a pilot forward flush mode by closing the first, third and fourth flow valves and opening the second flow valve.

11. A method of flushing liquid fuel from valves and nozzles in a gas turbine via a mixing valve assembly, the mixing valve assembly having a plurality of flow passages including a pilot fuel inlet, a water inlet, a main fuel inlet, a pilot discharge, and a main discharge, and a plurality of flow valves cooperable with the flow passages including a first flow valve positioned between the pilot fuel inlet and the pilot discharge, a second flow valve positioned between the water inlet and the pilot discharge, a third flow valve positioned between the water inlet and the main discharge, and a fourth flow valve positioned between the main fuel inlet and the main discharge, the method comprising:

(a) flowing water in a pilot forward flush mode by closing the first, third and fourth flow valves and opening the second flow valve such that the water flows through the water inlet to the pilot discharge;

(b) flowing water in a pilot forward/reverse flush mode by closing the third and fourth flow valves and opening the first and second flow valves such that the water flows through the water inlet to the pilot fuel inlet and the pilot discharge;

(c) flowing water in a main forward flush mode by closing the first, second and fourth flow valves and opening the third flow valve such that the water flows through the water inlet to the main discharge;

(d) flowing water in a main forward/reverse flush mode by closing the first and second flow valves and opening the third and fourth flow valves such that the water flows through the water inlet to the main fuel inlet and the main discharge;

(e) interrupting steps (a)-(d) for a period of no flow; and (f) repeating steps (a)-(e).

12. A method according to claim 11, wherein step (e) comprises interrupting steps (a)-(d) for a period of 10-30 seconds.

13. A method according to claim 11, wherein a first amount of water is flowable through the water inlet to the pilot discharge and through the water inlet to the main discharge, and wherein steps (b) and (d) are practiced such that a second amount of water flowable through the water inlet to the pilot fuel inlet and through the water inlet to the main fuel inlet is greater than the first amount.

14. A method according to claim 11, wherein steps (a)-(f) are practiced according to a mixing valve flush strategy that varies according to whether a pilot circuit, including the pilot fuel inlet, the water inlet and the pilot discharge, or a main circuit, including the main fuel inlet, the water inlet and the main discharge, is being flushed, the mixing valve flush strategy including at least one of an amount of water flow and a duration of the water flow.

15. A method according to claim 14, wherein the mixing valve flush strategy further varies based on an operating status of the gas turbine.

16. A method according to claim 14, wherein steps (a)-(d) are practiced by simultaneously flushing the pilot circuit and the main circuit.

17. A method of flushing liquid fuel from valves and nozzles in a gas turbine via a mixing valve assembly, the mixing valve assembly including flow passages for fuel and water, the method comprising (a) flowing water through the flow passages, (b) interrupting the flow for a specified period of no flow, and (c) repeating steps (a) and (b) such that the water flow is pulsed through the flow passages.

* * * * *